US009228402B2

(12) United States Patent
Strilchuk

(10) Patent No.: US 9,228,402 B2
(45) Date of Patent: Jan. 5, 2016

(54) ANTI-STALL BYPASS SYSTEM FOR DOWNHOLE MOTOR

(71) Applicant: Bico Drilling Tools, Inc., Houston, TX (US)

(72) Inventor: Nathan Strilchuk, Kingman (CA)

(73) Assignee: BICO DRILLING TOOLS, INC., Houston, TX (US)

( * ) Notice: Subject to any disclaimer, the term of this patent is extended or adjusted under 35 U.S.C. 154(b) by 256 days.

(21) Appl. No.: 14/046,562

(22) Filed: Oct. 4, 2013

(65) Prior Publication Data

US 2015/0096807 A1 Apr. 9, 2015

(51) Int. Cl.
*E21B 4/02* (2006.01)
*E21B 21/10* (2006.01)

(52) U.S. Cl.
CPC ..... *E21B 21/103* (2013.01); *E21B 4/02* (2013.01)

(58) Field of Classification Search
CPC ..... E21B 7/00; E21B 34/10; E21B 34/103
See application file for complete search history.

(56) References Cited

U.S. PATENT DOCUMENTS

| | | | | |
|---|---|---|---|---|
| 3,005,507 | A | 10/1961 | Clark, Jr. et al. | |
| 3,989,114 | A | 11/1976 | Tschirky et al. | |
| 4,298,077 | A | 11/1981 | Emery | |
| 4,396,071 | A | 8/1983 | Stephens | |
| 4,632,193 | A | 12/1986 | Geczy | |
| 4,768,598 | A | 9/1988 | Reinhardt | |
| 6,095,249 | A | 8/2000 | McGarian et al. | |
| 6,263,969 | B1 | 7/2001 | Stoesz et al. | |
| 6,540,020 | B1 | 4/2003 | Falgout, Sr. | |
| 6,568,485 | B2 | 5/2003 | Falgout, Sr. | |
| 7,086,486 | B2 | 8/2006 | Ravensbergen et al. | |
| 8,893,805 | B2 * | 11/2014 | McGarian | 166/374 |
| 2009/0242211 | A1 * | 10/2009 | Fagley et al. | 166/374 |
| 2013/0319767 | A1 * | 12/2013 | Wilson et al. | 175/24 |

* cited by examiner

*Primary Examiner* — William P Neuder

(57) ABSTRACT

A flow control valve for use with a downhole motor includes a housing with at least one port and a sleeve with at least one opening. The sleeve is movable within the housing to align and offset the ports and openings. A first biasing member associated with a first portion of the sleeve and a second biasing member associated with a second portion of the sleeve bias the sleeve in a first direction, while pressure applied to the sleeve due to fluid flow moves the sleeve in an opposing second direction. Movement of the sleeve in the second direction compresses the first and second biasing members, disengages the first portion of the sleeve from the first biasing member, and aligns the openings with the ports to permit transmission of the pressure through the openings and ports.

20 Claims, 8 Drawing Sheets

ANTI-STALL BYPASS SYSTEM FOR DOWNHOLE MOTOR

FIELD

Embodiments usable within the scope of the present disclosure relate, generally, to valves usable to divert and/or control the flow of fluid in a borehole, and more specifically, to flow control and/or bypass valves usable to regulate the flow of fluid to a downhole motor.

BACKGROUND

When drilling a well, a bore is formed in the earth and extended via rotation of a drill bit, which is attached at the end of a string of tubulars. The drill bit can be rotated by rotating the attached tubular string, e.g., using a rotatable member engaged with the tubular string at the surface, though during some operations—most notably directional drilling operations—the drill bit is rotated using a downhole motor (e.g., a progressive cavity positive displacement pump). Typical downhole motors rotate an associated drill bit responsive to the flow of drilling fluid through the motor. Specifically, a movable rotor, positioned within a stator housing, rotates due to the pressure of the drilling fluid applied to the rotor. The rate at which the borehole can be extended, often referred to as the ROP (rate of penetration), can be optimized by providing a significant amount of weight to the drill bit (termed the weight-on-bit (WOB)).

In operations where a downhole motor is used, operators may often attempt to increase the ROP by providing drilling fluid into the tubular string in excess of the tolerance of the downhole motor. If the motor lacks sufficient horsepower or momentum to continue the drilling operation, the motor may stall. In other situations, the characteristics of the formation or damage to the drill bit can contribute to stalling of the motor. If the differential pressure across the motor becomes extremely high, which can readily occur during a stall, the continued provision of drilling fluid into the motor can cause severe damage to the motor—primarily to the rubber, composite, and/or elastomeric liner of the stator housing, as well as to other power transmission components (e.g., the flex shaft or tie-rod).

Stalls can often be prevented, by an operator, if a signal or indication of the pressure differential is communicated to the surface; however, lack of operator responsiveness and/or the incentive to maximize the ROP in spite of the risk of a stall can hinder the effectiveness of a human response. Additionally, in instances where formations vary greatly, little can be done to prevent damage to the drill bit, mud motor, and/or associated components in the bottomhole assembly. Mechanical devices can be used to reduce the damage caused by a stall, e.g., by detecting conditions indicative of a stall or conditions that may potentially lead to a stall, such as reduced motor speed and/or pressure in the tubular spring, then diverting the flow of fluid away from the motor, but mechanical devices are prone to damage and/or failure. Additionally, mechanical forces, such as those caused by the rapid extension of springs, can be significant, causing damage to threaded connections, tools, and other components, interfering with measurements in instruments and sensors in the bottomhole assembly, and potentially un-torqueing connections in the tubular string. Mechanical devices are also limited by size constraints, and are often unsuitable for use within smaller strings and wellbores. Further, many mechanical devices require use of a physical object that can obstruct the bore of the tubular string, such as a ball or dart, that must later be removed and/or otherwise overcome when it is desired to actuate other ball-activated tools located downhole from the device.

A need exists for devices and methods usable to control the flow of drilling fluid and bypass a downhole motor that can be activated and reset by a pressure differential to reduce the likelihood of a stall and/or minimize damage to components should a stall occur.

A need also exists for devices and methods usable to bypass fluid into the annulus about a tubular string to assist in moving cuttings and solids to the surface to improve the condition of the wellbore, while bleeding excess pressure from the tubular string.

A further need exists for devices and methods that can control the flow of drilling fluid to a downhole motor while leaving the central bore of the tubular string generally unobstructed, and can selectively allow split flow (e.g., partial flow toward the drill bit) to enable rotation of the bit, e.g., via the motor mount.

Embodiments usable within the scope of the present disclosure meet these needs.

SUMMARY

Embodiments usable within the scope of the present disclosure include flow control valves that include a housing with a sidewall, an axial bore, and at least one port (e.g., a lateral and/or radial port) extending through the sidewall. A sleeve, movably disposed in the bore of the housing, that includes a tubular body having at least one opening extending therethrough, can be moved relative to the housing (e.g., in an axial direction) to align and offset the opening(s) of the sleeve with the port(s) of the housing.

A first biasing member (e.g., one or more springs, a spring pack, one or more cylinders, or other types of actuators or similar components able to provide a force) is associated with a first portion of the sleeve, and biases the sleeve in a first direction (e.g., an uphole direction), and a second biasing member is associated with a second portion of the sleeve, and also biases the sleeve in the first direction. The first portion of the sleeve is movable between a first position in which the sleeve is engaged with the first biasing member, and a second position in which the sleeve is disengaged from the first biasing member. For example, in an embodiment, the first portion of the sleeve can include a collet, movable between an expanded position in which the collet is associated with a spring pack or other type of biasing member, and a compressed position in which the collet is disassociated from the biasing member. A locking member (e.g., a sleeve or similar object) can be positioned to retain the collet in the expanded position, and biased toward the collet (e.g., in a downhole direction).

In use, a pressure applied to the sleeve (e.g., via the flow of drilling fluid in a downhole direction through a drilling string, through the sleeve, to a downhole motor) moves the sleeve in a second direction opposite the first (e.g., in a downhole direction), thereby compressing the first and second biasing members, disengaging the first portion of the sleeve from the first biasing member, and moving the sleeve to align the opening(s) therein with the port(s) in the housing to permit transmission of pressure from within the sleeve through the one or more aligned openings and ports. In an embodiment, a stop member (e.g., a pin extending from one of the sleeve or the housing into a slot formed in the other) can be used to limit axial and/or rotational movement of the sleeve relative to the housing. Alternatively or additionally, one or more shoulders and/or steps in the sleeve and/or the housing can abut to limit relative axial movement between the members.

A reduction in pressure in the sleeve can enable the second biasing member to move the sleeve toward its original position (e.g., in an uphole direction), thereby re-engaging the first portion of the sleeve with the first biasing member.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the disclosure in detail, it is to be understood that the disclosure is not limited to the particular embodiments described herein. The disclosure and description herein is illustrative and explanatory of one or more example embodiments, and it will be appreciated by those skilled in the art that various changes in the design, organization, order of operation, means of operation, equipment structures and location, methodology, and use of mechanical equivalents may be made without departing from the spirit of this disclosure.

As well, it should be understood the drawings are intended illustrate and disclose example embodiments to one of ordinary skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of this disclosure as described herein.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Figure 1A:
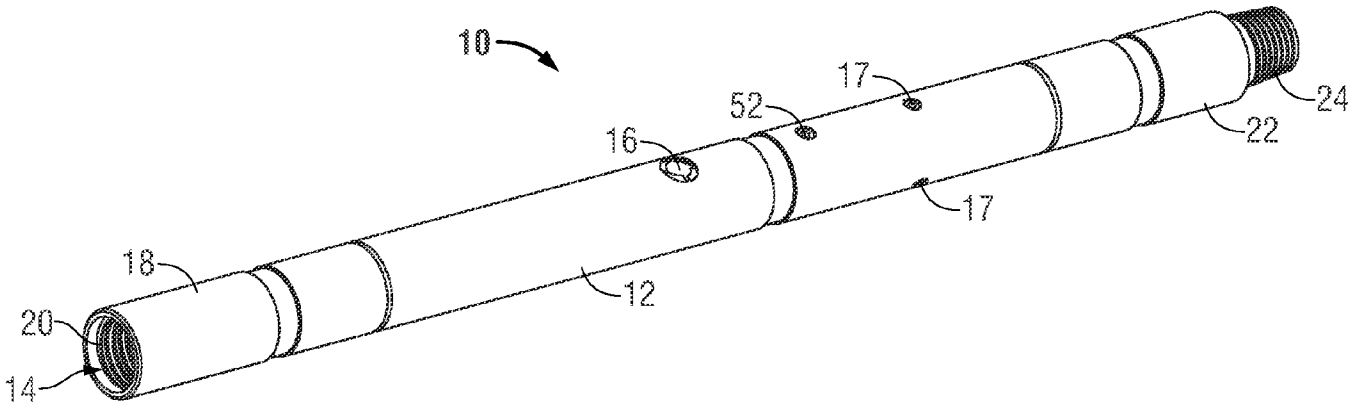
FIG. 1A depicts an isometric view of an embodiment of a flow control valve usable within the scope of the present disclosure.
Figure 1B:
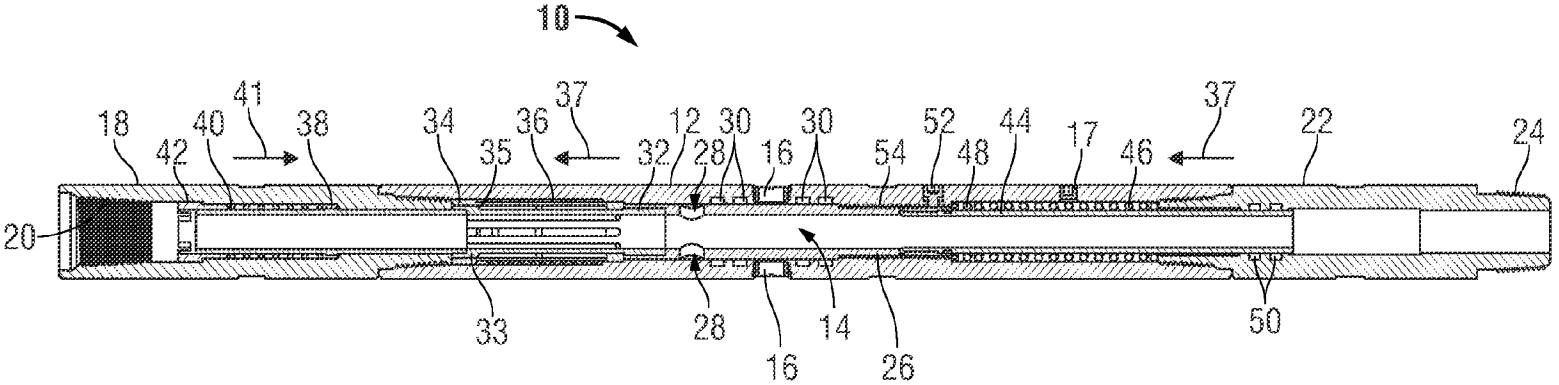
FIG. 1B depicts a side cross-sectional view of the flow control valve of FIG. 1A.

FIGS. 1A and 1B depict an isometric and side cross-sectional view, respectively, of an embodiment of a flow control valve (10) usable within the scope of the present disclosure is shown. The depicted valve (10) includes a generally tubular housing (12) having a sidewall with an axial bore (14) for accommodating the flow of fluid (e.g., drilling mud and/or other wellbore fluids) therethrough. One or more ports (16) (e.g., lateral/radial openings) extends through the housing (12) for communicating fluid from the axial bore (14) to the annulus and/or other space external to the valve (10). Specifically, FIG. 1B depicts two ports (16) within the housing (12), though it should be understood that any number of openings having any dimensions and/or spacing can be present without departing from the scope of the present disclosure.

An upper sub (18) having interior threads (20) (e.g., box threads) and a lower sub (22) having exterior threads (24) (e.g., a pin end) are shown secured to the housing (12) at opposing ends thereof (e.g., using threaded connections, a snap-fit, a force-fit, welds, fasteners, and/or other types of connections). The interior and exterior threads (20, 24) can be usable to engage the valve (10) with adjacent tools and/or conduits, such as segments of a drilling string or other type of tubular string, portions of a bottom hole assembly, and/or other downhole conduits and/or components. As such, fluid can be provided, e.g., from a source at the surface or another fluid source, through a drilling string, tool string, and/or other type of tubular string, into and through the axial bore (14) of the housing (12), to other conduits and/or tools positioned downhole. For example, during typical use, a mud motor or other type of fluid-driven downhole motor can be positioned downhole from the valve (10) (e.g., directly downhole therefrom, via attachment to the bottom sub (22), or through attachment to one or more intermediate conduits and/or tools).

A sleeve (26) is shown positioned within the bore (14) of the housing (12), the sleeve (26) having a generally tubular body with a bore therein. The sleeve (26) is shown positioned generally concentrically within in the housing (12), such that the bore of the sleeve (26) and that of the housing (12) overlap to form a continuous fluid pathway through the valve (10). The sleeve (26) includes one or more openings (28) (e.g., lateral and/or radial openings) extending through the body thereof, for communicating fluid from the axial bore (14) to the annulus and/or other space external to the valve (10). When the sleeve (26) is positioned as shown in FIG. 1B, the openings (28) are isolated from the ports (16) in the housing (12), e.g., using one or more sealing elements (30), such as o-rings or other similar types of seals, such that pressure and/or fluid from within the axial bore (14) is isolated from the annulus external to the valve (10).

A first end/portion of the sleeve (26) is shown having a collet (32) associated therewith (e.g., threaded and/or otherwise engaged thereto). The collet (32) is shown having a generally tubular body with a plurality of elongate projections interspersed with spaces therebetween, to allow compression and expansion of the collet (32), e.g., by inward and outward movement of the projections. In an alternative embodiment, an equivalent of the collet (32) exists by replacing the collet (32) with a latch and latching mechanism. A rear diagonal shoulder (35) of the collet (32) is shown abutting a complementary shoulder of a collet support (34), which is biased in a first direction (37) (e.g., toward the upper sub (18)) using a spring pack (36). In an embodiment, the spring pack (36) can include a combination of wave springs and spacers, selected to provide the spring back (36) with a desired strength and/or biasing force; however, it should be understood that any type of spring or any other type of fluid-driven, mechanical, and/or electrical biasing member can be used without departing from the scope of the present disclosure, such as compression springs, disc springs, and the like. As such, when the collet (32) is engaged with the collet support (34), the collet (32) and other components engaged therewith (e.g., the sleeve (26) and components connected thereto) are biased in the first direction (37) by the spring pack (36).

The collet (32) is also shown including a front diagonal shoulder (33), which provides the collet (32) with an end having a larger diameter than the opposing end, such that the larger-diameter end of the collet (32) can accommodate a locking sleeve (38), which is shown abutting the front diagonal shoulder (33). The locking sleeve (38) thereby restricts compression of the collet (32) in an inward direction. A spring (40) or similar biasing member can be used to bias the locking sleeve (38) in a second direction (41) (e.g., toward the lower sub (22)). A retainer nut (42) is shown securing the locking sleeve (38) and/or spring (40) within the upper sub (20).

A second end/portion of the sleeve (26) is shown having a stem and/or lower sleeve (44) associated therewith (e.g., threaded and/or otherwise engaged thereto). A spring (46) or similar biasing member can be used to bias the stem and/or lower sleeve (44) (and other attached components, such as the sleeve (26) and collet (32)) in the first direction (37) (e.g., toward the upper sub (20)). Fluid pressure from the annulus or other space external to the valve (10) can be communicated through one or more ports (17) positioned proximate to the lower sleeve (44) and/or spring (46), where pressure therefrom can contact a push plate (48) and further bias the sleeve (26) and other attached components in the first direction (37). Sealing members (50) (e.g., o-rings or similar types of seals) are shown positioned in the lower sub (22) to fluidly isolate the port (17) from the axial bore (14).

The sleeve (26) is movable within the axial bore (14) of the housing (12) between a position in which one or more of the openings (28) is aligned with respective ports (16) in the housing (12), and a position, such as that shown in FIG. 1B, in which the ports (16) and openings (28) are offset (e.g., isolated from one another). FIGS. 1A and 1B depict a guide pin (52) within the housing (12) that protrudes into a guide slot (54) formed in the sleeve (26). The guide pin (52) can limit movement axial movement of the sleeve (26) relative to the housing (12), e.g., through contact between the pin (52) and the ends of the slot (54). In an embodiment, contact between the sides of the slot (54) and the guide pin (52) can limit relative rotational movement between the sleeve (26) and housing (12). For example, the slot (54) could have a generally linear shape, parallel to the axis of the bore (14), thereby preventing relative lateral and/or rotational movement of the sleeve (26) and housing (12).

During normal use, when drilling fluid is supplied to a downhole motor engaged with the valve (10), e.g., by positioning the motor in a direction downhole from the valve (10), drilling fluid is provided from the surface, through a tubular string, through the axial bore (14) of the valve (10), and to the downhole motor. The pressure in the axial bore (14), imparted by the fluid, is applied to the uphole end of the collet (32), biasing the collet (32), sleeve (26), and lower sleeve (44) in a downhole direction, but the force from the drilling fluid is counteracted by the spring pack (36) associated with the collet (32), the spring (46) associated with the lower sleeve (44), and the annular fluid pressure applied to the push plate (48) through the ports (17). The components of the valve (10) would remain positioned generally as shown in FIGS. 1A and 1B under such circumstances.

When a pressure differential between the fluid in the axial bore (14) and that in the annulus external to the valve (10) exceeds a preset tolerance of the valve (10), which can be pre-set through the configuration of the spring pack (36) and/or the spring (46), the collet (32) and collet support (34), as well as the associated sleeves (14, 44) can be moved in a downhole direction, compressing the spring pack (36) and the spring (46).

Figure 2:
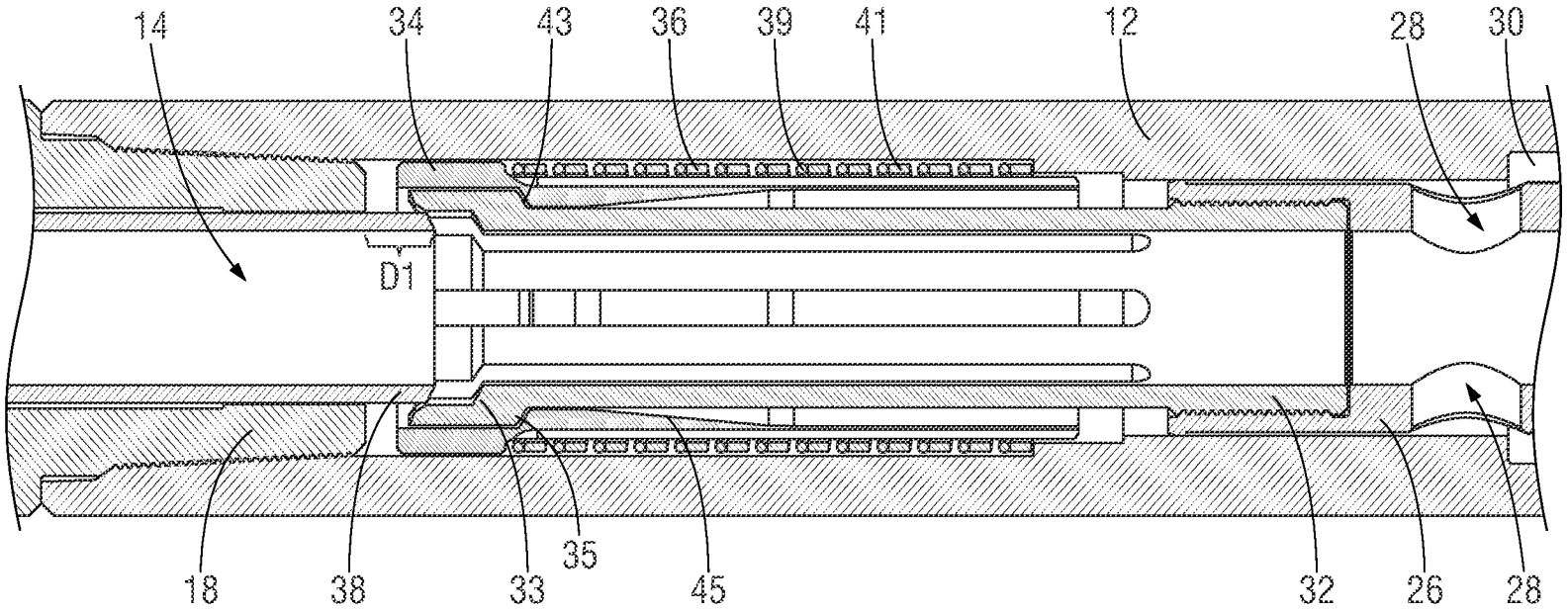
FIG. 2 depicts a diagrammatic side cross-sectional view of a portion of the valve of FIG. 1B.

FIG. 2 depicts a diagrammatic side cross-sectional view showing a portion of the valve of FIGS. 1A and 1B, namely, the portion of the housing (12) containing the collet (32), collet support (34), and associated spring pack (36), proximate to the upper sub (18). While components of the spring pack (36) can vary depending on the desired force to be provided by the spring pack (36), FIG. 2 depicts the spring pack (36) including wave springs (39) and spacers (41), provided in an alternating configuration. When the pressure of the drilling fluid in the axial bore (14) exceeds the force provided by the spring pack (36), the spring (46, shown in FIG. 1B), and annular fluid pressure applied to the push plate (48, shown in FIG. 1B), the collet (32), collet support (34), and the associated sleeve (26) and lower sleeve (44, shown in FIG. 1B) are moved in a downhole direction an axial distance (D1), through compression of the spring pack (36) and the spring (46, shown in FIG. 1B). The first distance (D1) is sufficient for the uphole end of the collet (32) to clear the end of the locking sleeve (38), thereby allowing compression of the collet (32) to a smaller diameter.

Continued application of pressure in the axial bore (14) can cause the rear diagonal shoulder (35) of the collet (32) to slide inwardly along the complementary shoulder (43) of the collet support (34), until the collet (32) has compressed a sufficient lateral/radial distance to disengage the collet (32) from the support (34) and the associated spring pack (36). The collet (32) can then continue to be moved along the sloped inner surface (45) of the collet support (34) by the fluid pressure in the bore (14). Once the collet (32) is no longer engaged with the support (34) (e.g., through abutment between the rear diagonal shoulder (35) and the complementary shoulder (43), while the collet (32) is retained in its expanded position using the locking sleeve (38)), the biasing force from the spring pack (36) move the collet support (34) in an uphole direction to its original position as the spring pack (36) expands.

Figure 3:
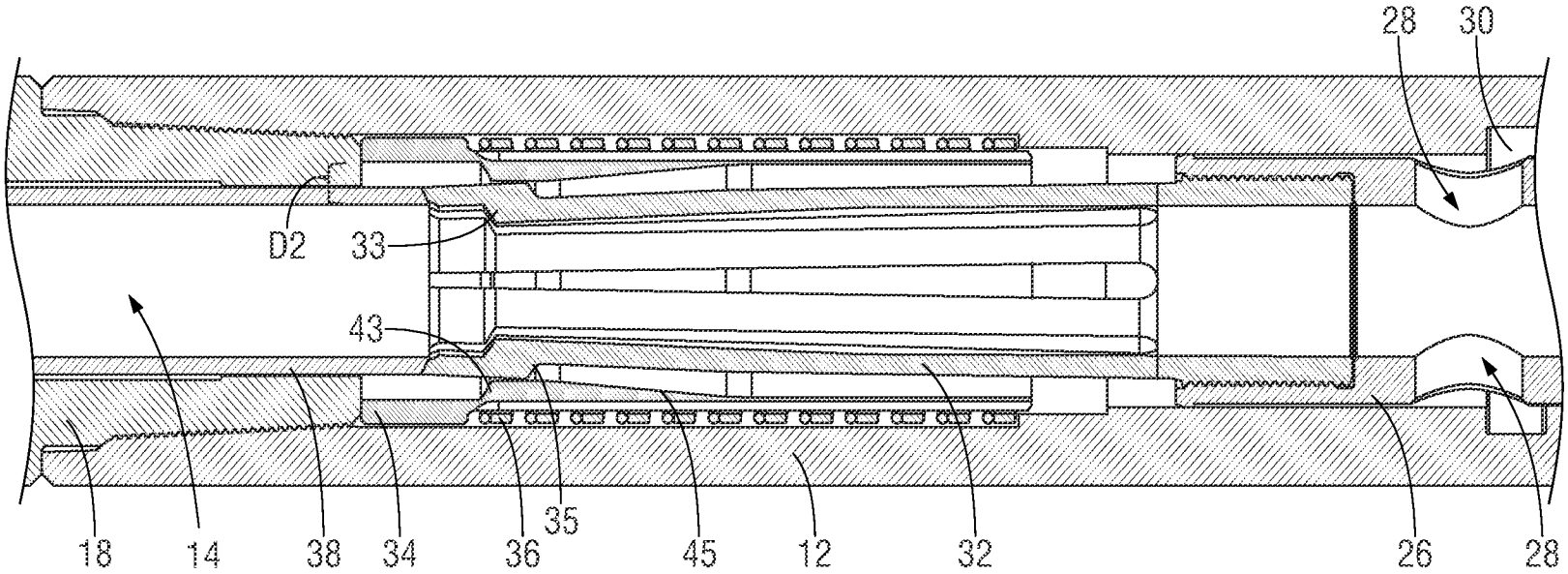
FIG. 3 depicts a diagrammatic side cross-sectional view of a portion of the valve of FIG. 1B.

FIG. 3 depicts a diagrammatic side cross-sectional view showing a portion of the valve of FIGS. 1A and 1B, namely, the portion of the housing (12) containing the collet (32), collet support (34), and associated spring pack (36), proximate to the upper sub (18). After movement of the collet (32) a lateral distance (D1, shown in FIG. 2) sufficient to position the end of the collet (32) downhole from the end of the locking sleeve (38), the collet (32) can be compressed a lateral and/or radial distance (D2) to a smaller diameter, e.g., thorough movement of the rear diagonal shoulder (35) of the collet (32) along the complementary shoulder (43) of the collet support (34). Once the collet (32) is no longer axially and/or horizontally aligned with the collet support (34), the pressure applied to the collet (32) via fluid in the axial bore (14) is no longer significantly applied to the collet support (34). The biasing force from the spring pack (36) is thereby able to move the collet support (34) in an uphole direction to return the support (34) to its initial position. Movement of the collet (32) in a downhole direction, and/or movement of the collet support (34) in an uphole direction positions the outer surface of the collet (32) along the sloped inner surface (45) of the collet support (34), such that the continued application of pressure to the collet (32) can cause movement thereof along the sloped inner surface (45). In an embodiment, movement of the collet (32), sleeve (26), and lower sleeve (44, shown in FIG. 1B) caused by the pressure in the axial bore (14) can accelerate subsequent to disengagement of the collet (32) from the collet support (34) and associated spring pack (36), due to the fact that the spring pack (36) no longer applies a biasing force to the collet (32) via the support (34).

Continued application of pressure in the axial bore (14), in excess of the force provided by the spring (46, shown in FIG. 1B) and annular pressure applied to the push plate (48, shown in FIG. 1B), can cause the collet (32), and the associated sleeve (26) and lower sleeve (44, shown in FIG. 1B) to continue to move in a downhole direction, until the openings (28) in the sleeve (26) are aligned with respective ports (16, shown in FIGS. 1A and 1B) in the housing (12).

Figure 4:
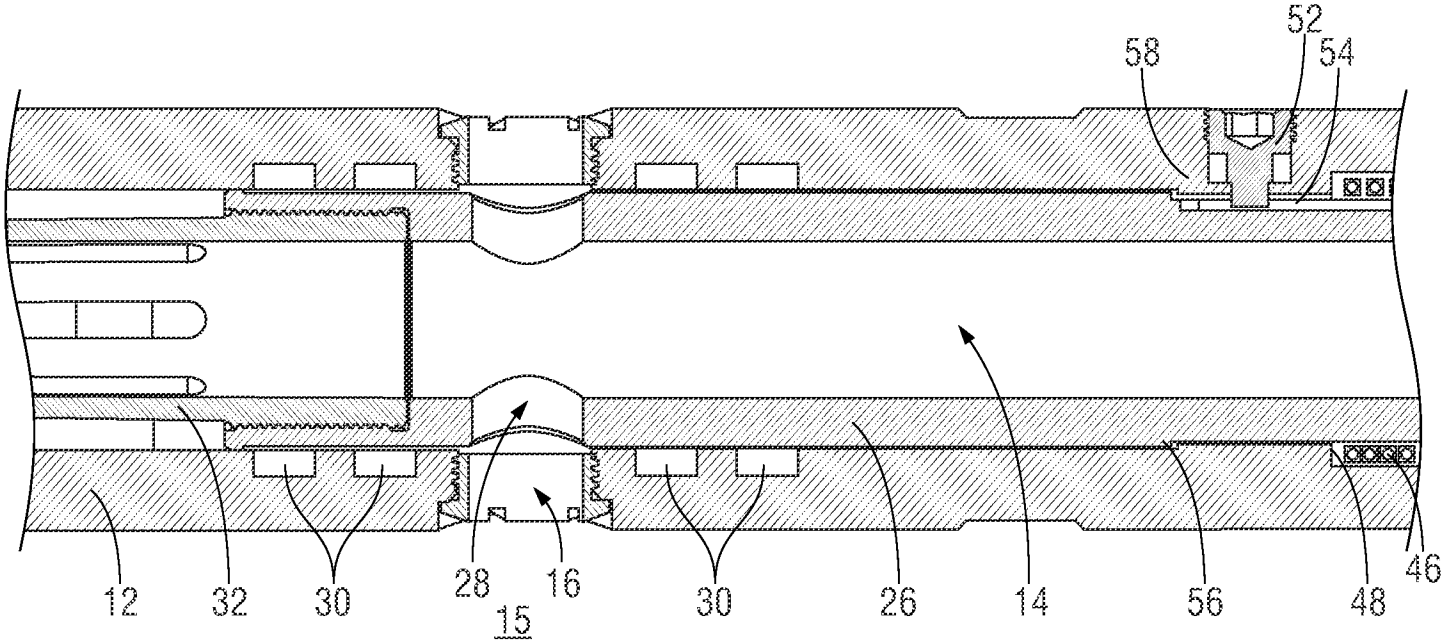
FIG. 4 depicts a diagrammatic side cross-sectional view of a portion of the valve of FIG. 1B.

FIG. 4 depicts a diagrammatic side cross-sectional view showing a portion of the valve of FIGS. 1A and 1B, namely, the portion of the housing (12) and sleeve (26) having the ports (16) and openings (28), respectively, extending therethrough. As described previously, after disengagement of the collet (32) from the collet support (34, shown in FIGS. 2 and 3) and the associated spring pack (36, shown in FIGS. 2 and 3), continued movement of the collet (32), and the associated sleeve (26) and lower sleeve (44, shown in FIG. 1B), in a downhole direction can continue until the openings (28) in the sleeve (26) are aligned with the ports (16) in the housing (12), thereby providing a fluid path between the axial bore (14) and the annulus (15) external to the housing (12), isolated by the sealing members (30). The flow of drilling fluid in the axial bore (14) (e.g., provided from a fluid source at the surface), to a downhole motor or other component located in a downhole direction from the valve is thereby limited due to the fact that at least a portion of the drilling fluid will flow through the aligned openings (28) and ports (16). While flow through the valve to a downhole motor could be entirely prevented due to the bypass fluid pathway through the openings (28) and ports (16), in an embodiment, the valve could be sized and/or configured to enable split flow, such that a portion of the drilling fluid sufficient to prevent damage to a downhole motor passes through the openings (28) and ports (16), while a quantity of drilling fluid may travel through the axial bore (14) to the downhole motor to enable turning of the drill bit, e.g., using the motor mount.

Movement of the sleeve (26) relative to the housing (12) can be limited through use of one or more stop members. For example, FIG. 4 depicts a shoulder (56) formed in the sleeve (26), that abuts a complementary shoulder (58) in the housing (12), such that additional movement of the sleeve (26) in a downhole direction is prevented. FIG. 4 also depicts the guide pin (52) within the slot (54). As described previously, movement of the sleeve (26) (e.g., axial and/or rotational movement) relative to the housing (12) can be limited through contact between the pin (52) and the edges of the slot (54). For example, in an embodiment, the slot (54) can have a generally linear shape (e.g., parallel to the axis of the bore (14)), such that contact between the pin (52) and the sides of the slot (54) prevents relative rotation between the sleeve (26) and housing (12).

After pressure within the axial bore (14) decreases, e.g., due to the exodus of fluid and/or pressure through the aligned openings (28) and ports (16), the spring (46) and annular pressure applied to the push plate (48) can move the sleeve (26), and the attached lower sleeve (44, shown in FIG. 1B) and collet (32) in an uphole direction. As the uphole end of the collet (32) contacts the inner sloped surface (45, shown in FIGS. 2 and 3) of the collet support (34, shown in FIGS. 2 and 3), the collet (32) can be compressed, then permitted to expand after passing the narrowest portion of the axial bore (14) (e.g., the widest portion of the inner sloped surface (45).

Figure 5:
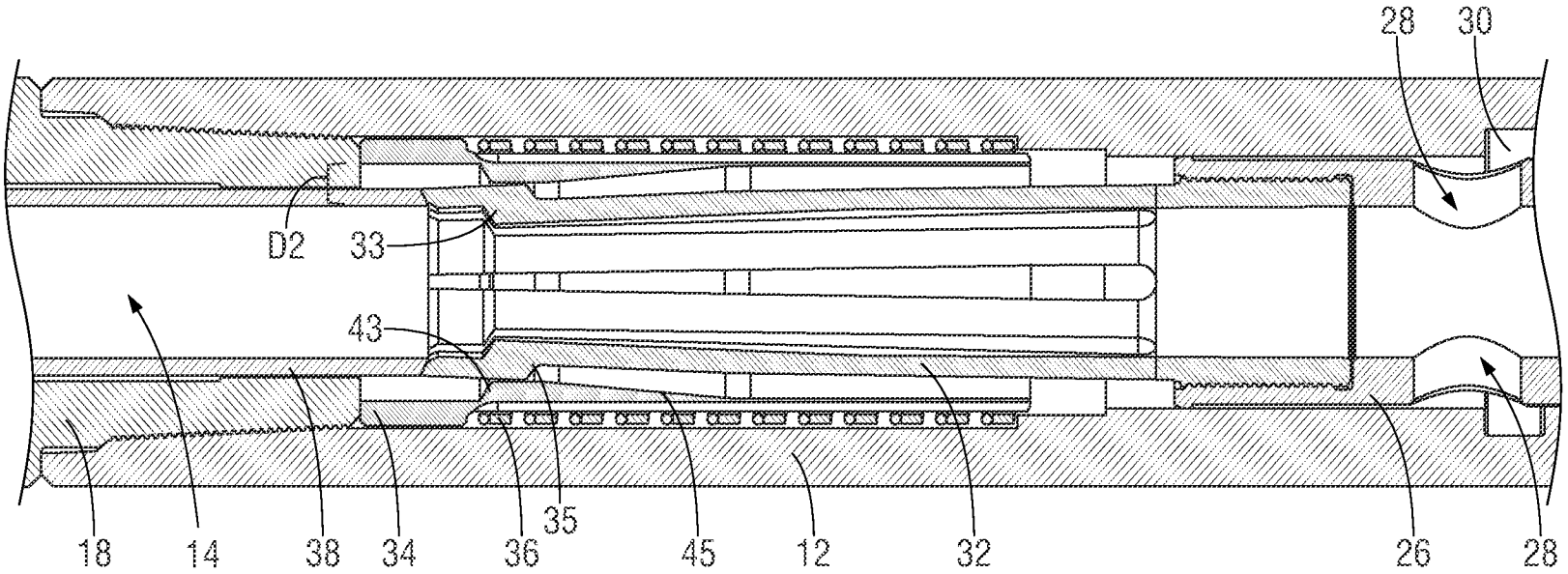
FIG. 5 depicts a diagrammatic side cross-sectional view of a portion of the valve of FIG. 1B.

FIG. 5 depicts a diagrammatic side cross-sectional view showing a portion of the valve of FIGS. 1A and 1B, namely, the portion of the housing (12) containing the collet (32), collet support (34), and associated spring pack (36), proximate to the upper sub (18). Movement of the collet (32), sleeve (26), and lower sleeve (44, shown in FIG. 1B) in an uphole direction (e.g., due to expansion of the spring (46, shown in FIG. 4) and the application of annular pressure to the push plate (48, shown in FIG. 4) offsets the openings (28) of the sleeve (26) from the ports (16, shown in FIG. 4), preventing the further communication of fluid and/or pressure from within the axial bore (14) to the annulus external to the valve. As the outer surface of the collet (32) moves along the inner sloped surface (45) of the collet support (34), the collet (32) is compressed, such that continued movement of the collet (32) in an uphole direction causes the front end of the collet (32) to contact the end of the locking sleeve (38).

Continued force applied to the collet (32) (e.g., due to the spring (46, shown in FIG. 4), and fluid pressure applied to the push plate (48, shown in FIG. 4)) can thereby cause movement of the locking sleeve (38) in an uphole direction, e.g., through compression of the associated spring (40, shown in FIG. 1B), allowing the collet (32) to be moved further uphole to its original position, where the collet (32) can expand, allowing the return of the locking sleeve (38) to a position that restrains the collet (32) in its expanded position.

Figure 6:
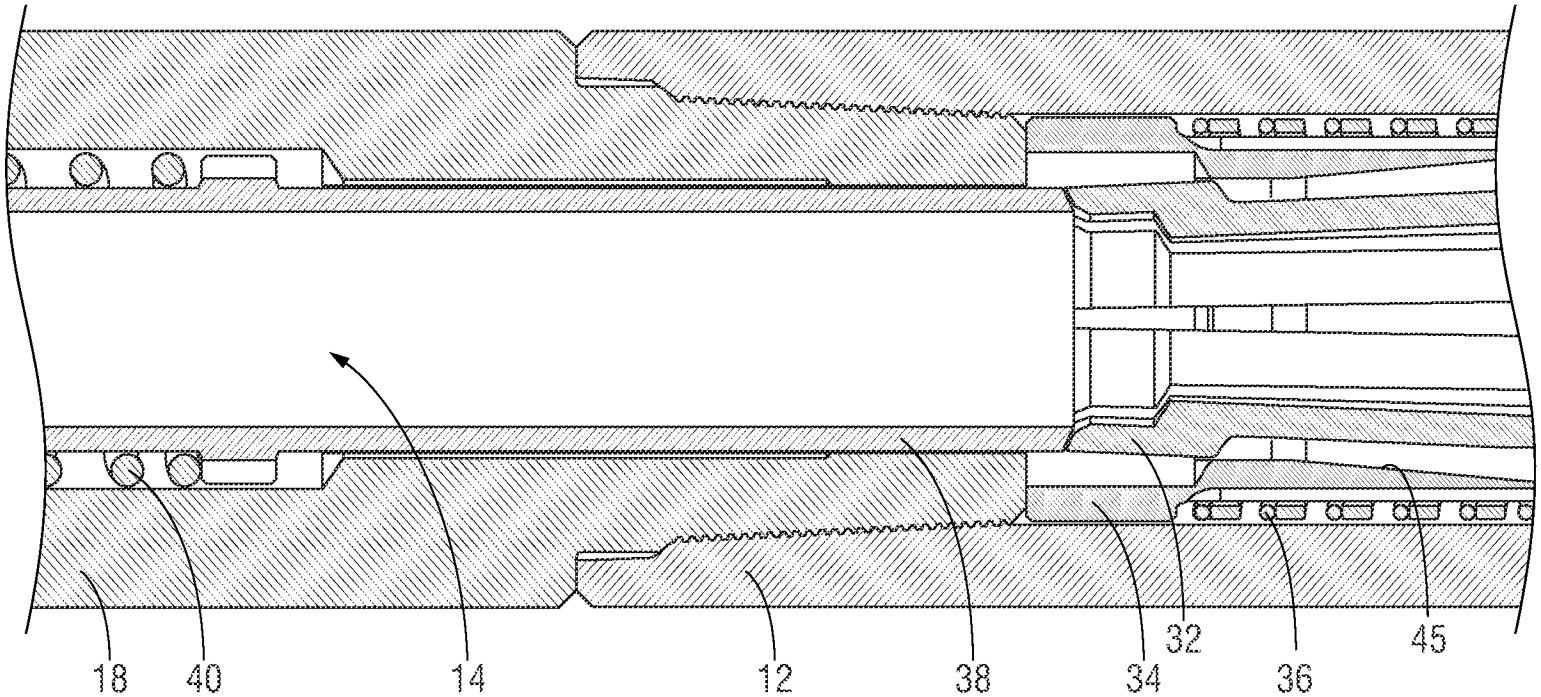
FIG. 6 depicts a diagrammatic side cross-sectional view of a portion of the valve of FIG. 1B.

FIG. 6 depicts a diagrammatic side cross-sectional view showing a portion of the valve of FIGS. 1A and 1B, namely, the portion of the housing (12) containing the collet (32), collet support (34), associated spring pack (36), upper sub (18), locking sleeve (38), and the spring (40) associated with the locking sleeve (38). As depicted, movement of the collet (32) in an uphole direction (e.g., along the sloped inner surface (45) of the collet support (34)), due to the force provided by the spring (46, shown in FIG. 4) and annular pressure against the push plate (48, shown in FIG. 4), can move the locking sleeve (38) in an uphole direction, compressing the associated spring (40). This can occur due to the lower spring (46, shown in FIG. 4) and/or the pressure against the push plate (48, shown in FIG. 4) exceeding the force provided by the upper spring (40). Continued movement of the collet (32) and locking sleeve (38) in an uphole direction can position the front end of the collet (32) uphole from the sloped inner surface (45) of the collet support (34), thereby allowing the collet (32) to return to its expanded position.

Figure 7:
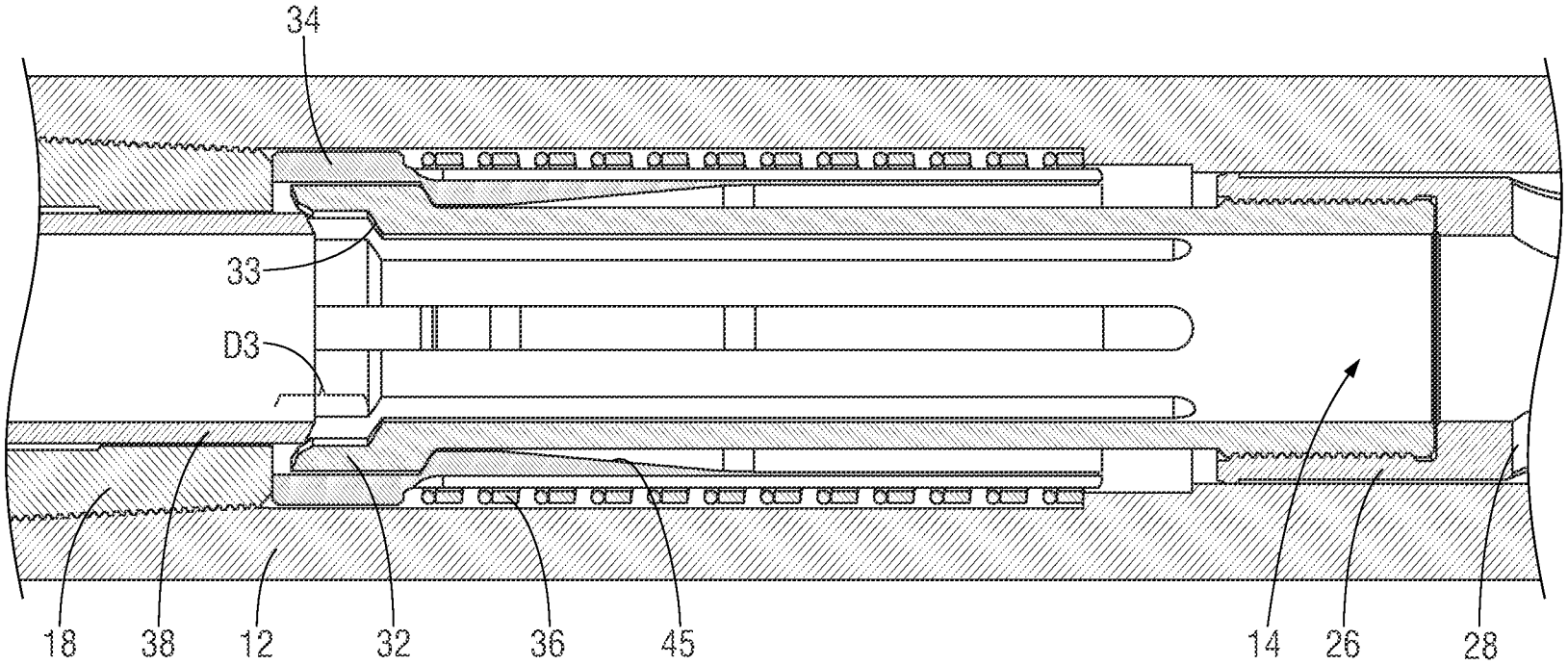
FIG. 7 depicts a diagrammatic side cross-sectional view of a portion of the valve of FIG. 1B.

FIG. 7 depicts a diagrammatic side cross-sectional view showing a portion of the valve of FIGS. 1A and 1B, namely, the portion of the housing (12) containing the collet (32), collet support (34), and associated spring pack (36), proximate to the upper sub (18). As shown, once the locking sleeve (38) has been moved an axial distance (D3) in an uphole direction, sufficient to permit the collet (32) to clear the sloped inner surface (45) of the collet support (34), the collet (32) can expand, e.g., due the resilient tendency thereof and/or due to contact between the front end of the collet (32) and the locking sleeve (38), which is biased in a downhole direction. Expansion of the collet (32) associates the collet (32) with the collet support (34), such that the spring pack (36) applies a biasing force in the uphole direction to the collet (32), which in turn biases the associated sleeve (26) and lower sleeve (44, shown in FIG. 1B). Once the collet (32) has expanded to its original position, the upper spring (40, shown in FIG. 6) can move the locking sleeve (38) in a downhole direction until the end thereof abuts the front diagonal shoulder (33) of the collet (32).

Figure 8:
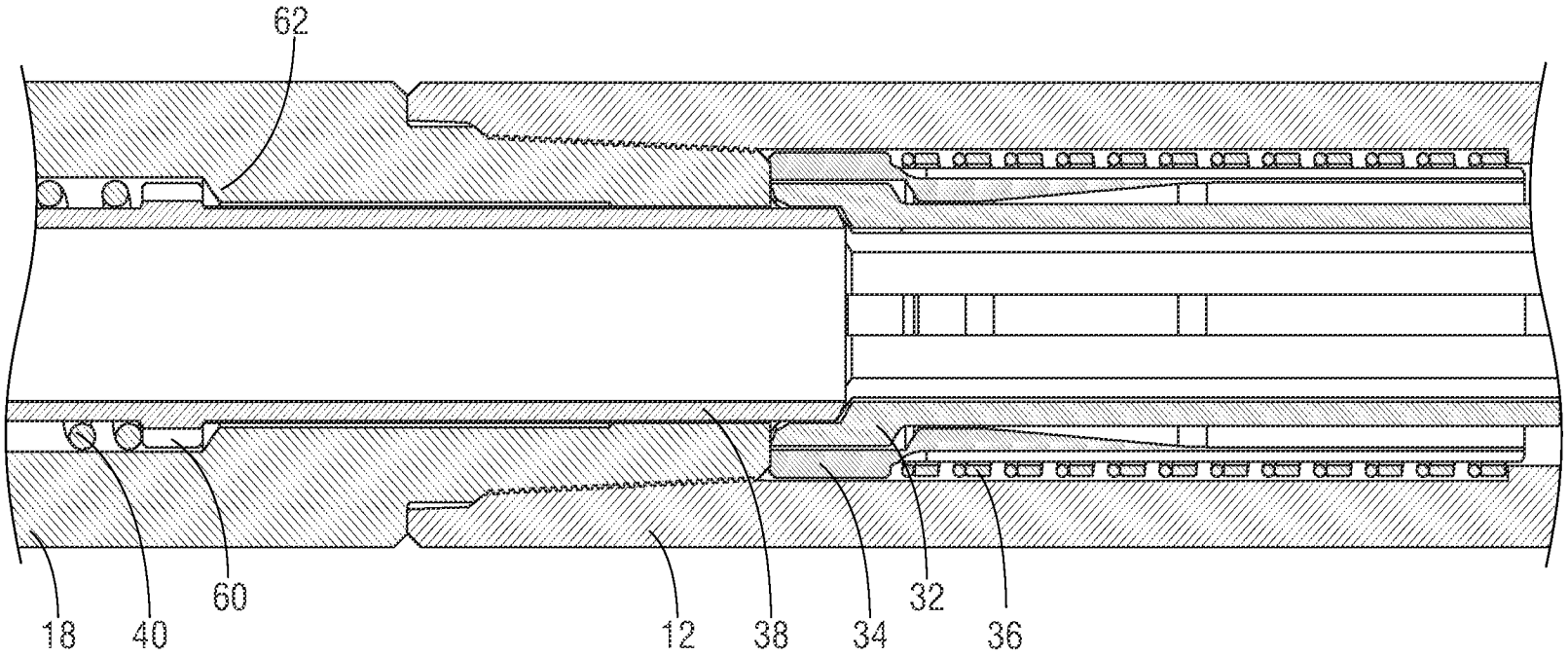
FIG. 8 depicts a diagrammatic side cross-sectional view of a portion of the valve of FIG. 1B.

FIG. 8 depicts a diagrammatic side cross-sectional view showing a portion of the valve of FIGS. 1A and 1B, namely, the portion of the housing (12) containing the collet (32), collet support (34), associated spring pack (36), upper sub (18), locking sleeve (38), and the spring (40) associated with the locking sleeve (38). As described above, expansion of the front end of the collet (32) into recesses within the collet support (34) permits movement of the locking sleeve (38) in a downhole direction via expansion of the spring (40). Expansion of the locking sleeve, e.g., such that the end thereof is proximate to the front diagonal shoulder (33) of the collet (32), restricts movement of the collet (32) toward a compressed position. A protrusion (60) in the locking sleeve is shown abutting a shoulder (62) in the upper sub (18), for limiting movement of the locking sleeve in a downhole direction, e.g., when the collet (32) and the associated sleeves (26, 44, shown in FIG. 1B) have been moved in a downhole direction away from the locking sleeve (38).

As such, FIG. 1B through FIG. 8 depict a general method by which the depicted valve (10) can operate. Initially, the valve (10) can be provided into a wellbore in the position shown in FIG. 1B, with the openings (28) and ports (16) offset from one another and the collet (32) expanded against the support (34) and retained in position by the locking sleeve (38). Fluid flow can progress through the axial bore (14) normally, e.g., to actuate a downhole motor located downhole from the valve (10), until the pressure differential between the fluid in the axial bore (14), which applies a force to the collet (32) and the associated sleeves (26, 44) in a downhole direction, and that in the annulus (15), which applies a force to the push plate (48) in an uphole direction, exceeds a preset value, determined at least in part by the configuration and/or strength of the spring pack (36) and/or the lower spring (46).

The pressure in the bore (14) thereby moves the collet (32) and sleeves (26, 44) in a downhole direction, compressing the spring pack (36) and spring (46), then disengaging the collet (32) from the collet support (34). While the spring pack (36) extends the collet support (34) to its original position, the pressure in the axial bore (14) continues to move the collet (32) and sleeves (26, 44) in a downhole direction, against the force provided by the lower spring (46) and the annular pressure applied to the push plate (48), until the openings (28) in the sleeve (26) are aligned with the ports (16) in the housing (12) to define a fluid path between the bore (14) and annulus (15).

Pressure in the axial bore (14) can thereby be bled off, into the annulus (15), until the pressure differential between the axial bore (14) and annulus (15) has decreased a sufficient amount to allow the lower spring (46) and/or the annular pressure against the push plate (48) to move the collet (32) and sleeves (26, 44) in an uphole direction, offsetting the ports (16) from the openings (28). Continued uphole movement of the collet (32) and sleeves (26, 44) abuts the downhole end of the locking sleeve (38) with the uphole end of the collet (32), and the continued application of force from the spring (46) and/or the annular fluid pressure causes the locking sleeve (38) to be moved in an uphole direction (compressing the spring (40)) until the collet (32) reaches its original position and is able to expand to once again engage the collet support (34). The upper spring (40) is then able to return the locking sleeve (38) to its original position, thereby resetting the valve (10) until the pressure differential is again exceeded.

While various embodiments usable within the scope of this disclosure have been described with emphasis, it should be understood that within the scope of the appended claims, the invention can be practiced other than as specifically described herein.

What is claimed is:

1. A flow control valve for a downhole motor, the valve comprising:

a housing having a sidewall, an axial bore, and at least one port extending through the sidewall;

a sleeve movably disposed within the axial bore of the housing, wherein the sleeve comprises a tubular body having a first portion, a second portion, and at least one opening extending through the tubular body, and wherein the sleeve is movable to align and offset said at least one opening with said at least one port of the housing;

a first biasing member associated with the first portion of the sleeve, wherein the first biasing member biases the sleeve in a first direction, and wherein the first portion of the sleeve is movable between a first position engaged with the first biasing member and a second position disengaged from the first biasing member; and a second biasing member associated with the second portion of the sleeve, wherein the second biasing member biases the sleeve in the first direction, and wherein a pressure applied to the sleeve moves the sleeve in a second direction opposite the first direction, thereby compressing the first biasing member, compressing the second biasing member, disengaging the first portion of sleeve from the first biasing member, and moving the sleeve to align said at least one radial opening with said at least one port of the housing to permit transmission of the pressure through said at least one opening and said at least one port.

2. The valve of claim 1, further comprising a stop member associated with the sleeve for limiting movement of the sleeve relative to the housing.

3. The valve of claim 2, wherein the stop member comprises a pin extending from one of the housing and the sleeve into a slot formed in the other of the housing and the sleeve.

4. The valve of claim 3, wherein the slot comprises a linear shape generally parallel to the axial bore of the housing for preventing rotational movement of the sleeve relative to the housing.

5. The valve of claim 2, wherein the stop member comprises a shoulder formed in one of the sleeve or the housing, and wherein the shoulder abuts a complementary surface in the other of the sleeve or the housing.

6. The valve of claim 1, wherein the first portion of the sleeve comprises a collet movable between an expanded position associated with the first biasing member and a compressed position disassociated from the first biasing member.

7. The valve of claim 6, further comprising a locking member adjacent to the collet, wherein the locking member limits movement of the collet toward the compressed position, and wherein movement of the sleeve in the first direction disassociates the collet from the locking member to allow movement of the collet toward the compressed position.

8. The valve of claim 7, further comprising a third biasing member associated with the locking member, wherein the third biasing member biases the locking member in the second direction, and wherein force applied by the second biasing member moves the sleeve in the second direction, thereby contacting the locking member with the collet, compressing the third biasing member, and moving the locking member to enable movement of the collet toward the expanded position.

9. A method for regulating fluid flow to a downhole motor, the method comprising the steps of:

providing a fluid to the downhole motor through an axial bore of a flow control valve;

applying a pressure to a sleeve of the flow control valve that comprises limiting movement of the sleeve in a direction relative to a housing, thereby moving the sleeve in a first direction, compressing a first biasing member and a second biasing member associated with the sleeve, and disengaging the sleeve from the first biasing member; and transmitting at least a portion of the pressure through an opening in the sleeve such that said at least a portion of the pressure bypasses the downhole motor, wherein a reduction of pressure in the sleeve enables the second biasing member to move the sleeve in a second direction opposite the first direction.

10. The method of claim 9, wherein the step of applying the pressure to the sleeve of the flow control valve that comprises limiting movement of the sleeve in the direction relative to the housing comprises limiting axial movement of the sleeve by moving a stop member associated with the sleeve into contact with a complementary stop feature.

11. The method of claim 10, wherein the step of limiting movement of the sleeve comprising by moving the stop member further comprises limiting rotational movement of the sleeve using contact between the stop member and the complementary stop feature.

12. The method of claim 9, wherein disengaging the sleeve from the first biasing member comprises moving a collet from an expanded position associated with the first biasing member to a compressed position disassociated from the first biasing member.

13. The method of claim 12, further comprising the step of restraining the collet in the expanded position using a locking member, wherein moving the sleeve in the first direction disengages the collet from the locking member.

14. The method of claim 13, further comprising the step of biasing the locking member in the first direction, wherein moving the sleeve in the second direction contacts the locking member with the collet, compresses the third biasing member, and moves the locking member to enable movement of the collet toward the expanded position.

15. The method of claim 9, wherein the step of transmitting said at least a portion of the pressure through the opening in the sleeve comprises transmitting a first portion of the pressure through the opening and a second portion of the pressure through the axial bore to the downhole motor.

16. The method of claim 9, wherein the step of applying the pressure to the sleeve of the flow control valve that comprises limiting movement of the sleeve in the direction relative to the housing comprises by abutting between or among one or more shoulders or steps in the sleeve, the housing, or combination thereof.

17. A bypass valve for use with a downhole motor, the valve comprising:

a housing having a sidewall, an axial bore, a first stop member, and at least one port extending through the sidewall;

a sleeve movably disposed within the bore of the housing, wherein the sleeve comprises a tubular body having a second stop member and at least one opening extending through the tubular body, wherein the sleeve is movable between a first position in which said at least one opening is aligned with said at least one port in the housing and a second position located in an uphole direction from the first position in which said at least one opening and said at least one port are offset, and wherein contact between the first stop member and the second stop member limits movement of the sleeve in the uphole direction beyond the second position and in a downhole direction beyond the first position;

a collet engaged with the sleeve;

a first biasing member associated with the collet, wherein the first biasing member biases the collet in the uphole direction, and wherein the collet is movable between an expanded position in which the collet is engaged with the first biasing member and a compressed position in which the collet is disengaged from the first biasing member;

a second biasing member associated with the sleeve, wherein the second biasing member biases the sleeve in the uphole direction toward the second position;

a locking member adjacent to the collet; and a third biasing member associated with the locking member, wherein the third biasing member biases the locking member in the downhole direction, wherein a pressure applied to the sleeve in excess of a first force provided by the first biasing member and a second force provided by the second biasing member moves the sleeve in the downhole direction, thereby compressing the first biasing member, compressing the second biasing member, disengaging the first portion of sleeve from the first biasing member, and moving the sleeve to the first position to align said at least one radial opening with said at least one port of the housing to permit transmission of the pressure through said at least one opening and said at least one port, and wherein transmission of the pressure through said at least one opening and said at least one port reduces the pressure in the axial bore to less than the provided by the second force provided by the second biasing member, thereby enabling the second biasing member to move the sleeve and the collet in the uphole direction, thereby contacting the locking member with the collet, compressing the third biasing member, and moving the locking member to enable movement of the collet toward the expanded position.

18. The valve of claim 17, wherein the stop member comprises a pin extending from one of the housing and the sleeve into a slot formed in the other of the housing and the sleeve.

19. The valve of claim 18, wherein the slot comprises a linear shape generally parallel to the axial bore of the housing for preventing rotational movement of the sleeve relative to the housing.

20. The valve of claim 17, wherein the stop member comprises a shoulder formed in one of the sleeve or the housing, and wherein the shoulder abuts a complementary surface in the other of the sleeve or the housing.

* * * * *